US009782802B2

(12) United States Patent
Berdelle-Hilge et al.

(10) Patent No.: US 9,782,802 B2
(45) Date of Patent: Oct. 10, 2017

(54) METHOD AND DEVICE FOR THE AUTOMATED HANDLING OF STACKS OF FLAT MAIL ITEMS

(71) Applicant: SIEMENS AKTIENGESELLSCHAFT, Munich (DE)

(72) Inventors: Peter Berdelle-Hilge, Konstanz (DE); Bertram Wanner, Meersburg (DE)

(73) Assignee: Siemens Aktiengesellschaft, Munich (DE)

( * ) Notice: Subject to any disclaimer, the term of this patent is extended or adjusted under 35 U.S.C. 154(b) by 46 days.

(21) Appl. No.: 14/438,298

(22) PCT Filed: Oct. 24, 2013

(86) PCT No.: PCT/EP2013/072293
§ 371 (c)(1),
(2) Date: Apr. 24, 2015

(87) PCT Pub. No.: WO2014/067848
PCT Pub. Date: May 8, 2014

(65) Prior Publication Data

US 2015/0273530 A1 Oct. 1, 2015

(30) Foreign Application Priority Data

Oct. 31, 2012 (DE) ..... 10 2012 219 912

(51) Int. Cl.
*B65H 1/30* (2006.01)
*B07C 1/02* (2006.01)
(Continued)

(52) U.S. Cl.
CPC ..... *B07C 1/025* (2013.01); *B65H 1/02* (2013.01); *B65H 1/30* (2013.01); *B65H 7/00* (2013.01);
(Continued)

(58) Field of Classification Search
CPC ..... B65H 1/30; B65H 2301/422542; B65H 15/02; B65H 1/025; B07C 1/025; B65G 65/23
See application file for complete search history.

(56) References Cited

U.S. PATENT DOCUMENTS 4,005,792 A * 2/1977 Schulman ..... B07C 1/025 414/416.09
5,271,710 A * 12/1993 Decharran ..... B07C 1/025 414/421
(Continued)

FOREIGN PATENT DOCUMENTS

DE 19827456 C2 5/2000
DE 102006025599 B3 9/2007
(Continued)

*Primary Examiner* — Anna Momper
*Assistant Examiner* — Mark Hageman
(74) *Attorney, Agent, or Firm* — Laurence Greenberg; Werner Stemer; Ralph Locher

(57) ABSTRACT

An automated flat mail items handling device includes a rotating apparatus, which rotates the stack during operation from a starting orientation, in which the mail items lie flat, one on top of the other, to a processing orientation, in which the mail items are arranged substantially standing next to each other. The device also includes a holder, which retains the stack while the stack is being rotated, and a transport support, which supports the stack in the processing orientation and by way of which the stack can be moved in a conveying direction. In order to be able to process more mail items per unit of time in the device and by way of the method, the transport support is separate from the rotating apparatus.

11 Claims, 22 Drawing Sheets

(51) Int. Cl.

| | |
|---|---|
| ***B65H 7/02*** | (2006.01) |
| ***B65H 15/02*** | (2006.01) |
| ***B65H 1/02*** | (2006.01) |
| ***B65H 7/00*** | (2006.01) |

(52) U.S. Cl.
CPC ..... *B65H 7/02* (2013.01); *B65H 15/02* (2013.01); *B65H 2301/4222* (2013.01); *B65H 2301/422542* (2013.01); *B65H 2701/1916* (2013.01)

(56) References Cited

U.S. PATENT DOCUMENTS

| | | | | |
|---|---|---|---|---|
| 5,713,713 | A | 2/1998 | Syde et al. | |
| 5,906,468 | A * | 5/1999 | Vander Syde | B07C 1/025 414/403 |
| 6,503,044 | B1 * | 1/2003 | Enenkel | B07C 1/02 414/403 |
| 6,575,306 | B1 | 6/2003 | Schuster et al. | |
| 6,793,454 | B2 | 9/2004 | Brizzi | |
| 7,195,236 | B2 * | 3/2007 | Hillerich, Jr. | B07C 1/025 271/149 |
| 7,467,792 | B2 * | 12/2008 | Bittenbender | B65H 1/025 271/105 |
| 7,572,094 | B2 * | 8/2009 | Miskiewicz | B65H 15/02 414/416.03 |
| 8,226,345 | B2 * | 7/2012 | De Leo | B65B 5/06 198/403 |
| 2002/0146308 | A1 | 10/2002 | Svyatsky et al. | |
| 2004/0193554 | A1 | 9/2004 | Hillerich, Jr. et al. | |
| 2005/0230899 | A1 | 10/2005 | Canini et al. | |
| 2011/0103929 | A1 | 5/2011 | Zimmermann | |
| 2012/0099956 | A1 | 4/2012 | Diehr et al. | |

FOREIGN PATENT DOCUMENTS

| | | | |
|---|---|---|---|
| DE | 102009051663 | A1 | 5/2011 |
| EP | 1350748 | A2 | 10/2003 |
| EP | 1585057 | A1 | 10/2005 |
| EP | 2447197 | A2 | 5/2012 |
| WO | 9805577 | A1 | 2/1998 |
| WO | 9823393 | A1 | 6/1998 |
| WO | 9942225 | A1 | 8/1999 |
| WO | 2006125128 | A2 | 11/2006 |
| WO | 2010140538 | A1 | 12/2010 |

* cited by examiner

METHOD AND DEVICE FOR THE AUTOMATED HANDLING OF STACKS OF FLAT MAIL ITEMS

BACKGROUND OF THE INVENTION

Field of the Invention

The invention relates to a device for the handling of a stack of flat mail items, said device having a rotary device which rotates the stack during operation from a starting orientation, in which the objects lie flat one on top of another, into a processing orientation, in which the objects are arranged substantially standing side by side, having a holding means which is developed to secure the stack when rotating, having a conveying support means which supports the stack in the processing orientation and by means of which the stack is movable into a feed direction.

The invention additionally relates to a method for the automated handling of stacks of flat mail items, where a stack is first of all provided in a starting orientation in which the mail items lie flat one on top of another, the stack is rotated by means of a rotary device into a processing orientation in which the mail items stand substantially side by side, wherein the stack is secured during the rotation and the rotary device is rotated from a first into a second position, the stack is conveyed in a feed direction.

Devices and methods of the abovementioned type are known from the prior art. Thus, for example, WO 2006/125128 describes a device and a method for re-aligning a stack of postal items, where a stack of postal items which is initially aligned horizontally is moved into a vertical alignment in a rotary station. A problem in this connection is that the processing volume per unit time is relatively low.

A further device from the prior art is described in DE 198 27 456 C2, in which flat postal items are reloaded from a horizontal alignment into a vertical alignment. Other devices for the automatic unloading of postal items are described, for example, in WO 99/42225 and U.S. Pat. No. 6,503,044 B1.

Too few mail items can be processed per unit time using the known methods and devices for the automatic unloading of stacks of postal items in order to supply, for example, a modern sorting facility in a sufficient manner.

BRIEF SUMMARY OF THE INVENTION

Consequently, the object underlying the invention is to provide a method and a device of the type named in the introduction, by way of which a larger number of mail items is able to be processed per unit time.

In the case of the device according to the invention, the object is achieved as a result of the conveying support means being realized separately from the rotary device.

In the case of the method according to the invention, the object is achieved as a result of the rotary device being rotated back into the first position during the conveying of the stack.

The advantage of the solution according to the invention is that as a result of separating the conveying support means and the rotary device, the rotary device can already be rotated back when the stack is being conveyed by the conveying support means. As a result of said parallel operating steps, more stacks of postal items can be processed within the same time period compared to devices from the prior art. The device and the method operate more efficiently as a result. The holding means and the conveying support means ensure that the stack is gripped and guided at all times and consequently a more process-reliable handling of the stack is ensured.

The invention can be further developed by advantageous developments which are independent of one another and are described below. Thus, the device can include a conveying tray which is realized for receiving the stack in the processing orientation and by means of which the stack is movable in the feed direction. The advantage of this is that the stack which is stored intermediately on the conveying tray is able to be moved without friction influences with respect to the supporting surface and as a result damage to the mail items is avoided. Such damage can occur, for example, as a result of a relative movement of the stack with respect to the supporting surface of the feed bed or with respect to conveying means in the storage region of the feed bed when a stack of mail items is advanced without a conveying tray on the feed bed or similar supporting surfaces. The conveying tray provides an independent invention.

In addition, the device can include a tray support means which supports the stack in the processing orientation and is movable in the feed direction, wherein the tray support means is arranged upstream of the transport support means in the feed direction when conveying the stack. As a result of said development, the stack is held by the tray support means and the conveying support means during conveying such that secure conveying of the stack is ensured.

In order to ensure process-reliable conveying of the stack into the storage region, the tray support means can be realized so as to be movable synchronously with the conveying tray.

In addition to this or as an alternative to this, the conveying support means can also be realized so as to be movable synchronously with the conveying tray.

In a further advantageous development, the holding means can be developed in a fork-shaped manner. The advantage of this is that the holding means is able to engage in a container which comprises openings that are complementary to the fork form and in which the stack is provided. For the same purpose, the conveying support means can also be developed in a fork-shaped manner.

In a further advantageous development of the device according to the invention, the transport support means and the tray support means can be developed so as to be movable in the feed direction and in opposition to the feed direction independently of one another.

In addition, the device can comprise a container for conveying the stack which comprises recesses which can be reached through for the transport support means and/or the holding means. The advantage of this is that the stack can be provided in the container and also processed in the container. When the stack is rotated with the container, the holding means and the conveying support means can secure the stack in the container against falling out or tipping up. As a result, the container does not have to be loaded separately such that there is a saving of one operating step.

In a further advantageous development, which provides an independent invention, the device can include a sensor, an evaluating device with internal logic that is connected to the sensor, by means of which a stack quality is determinable, and a presenting station in which the stack quality can be improved. To this end, the stack quality of the stack is first of all detected by the sensor and the evaluating unit and in the event of the stack quality being too poor, the stack is moved into the presenting station and stopped there. An operator can improve the stack quality manually, for example, in the presenting station. The advantage of this is that failures or faults in the device which are produced as a result of the stack quality being too poor can be avoided. Failures of the device are clearly reduced in this manner. In the simplest case, an operator can test and evaluate the stack quality visually as an alternative to the sensor.

In addition, the holding means can be coupled with the rotary device such that they are able to be moved in a synchronous manner. The advantage of this is that the holding means can hold the stack securely during the rotary of the rotary device. In the simplest case, the holding means can be mounted on the rotary device such that it automatically rotates with the rotary device.

In an advantageous further development of the method according to the invention, the stack can be provided in a container in the starting orientation and can be rotated together with the container. The advantage of this is that the stack of mail items is able to be processed further in the conveying container in which the mail items are usually conveyed prior to processing. This is a saving on a separate processing step for the removal of the stack out of the container such that the process is more efficient. In addition, the stack can be moved out of the container as a result of the conveying such that the container is unloaded. The advantage of rotating the stack in the container is that the side walls, rear wall and front wall of the container support the stack and the system is thus realized in a structurally simple manner. The holding means and the rotary device are developed in a corresponding manner such that the container and the stack are secured during rotating.

In order not to require further processing time for unloading the conveying container, the emptied conveying container can be rotated back by means of the rotary device. The rotating back can consequently be effected in parallel with other process steps.

In a further advantageous development, which provides an independent invention, the stack quality of the stack can be detected and a decision is then made in dependence on the stack quality whether the stack is suitable for the further automated method steps. If the decision is that the stack is not suitable, the stack is conveyed to a presenting station. An operator can correct the orientation and/or the position of the stack, for example, in the presenting station and the automated processing is then continued. The advantage of this is that stacks which are not suitable for processing and as a result of which faults or damage can occur to the device, are recognized prior to processing and can be corrected in the presenting station.

The recognizing of the stack quality can occur, for example, by means of an image processing system or as a result of determining the position of the uppermost mail item of the stack. Methods to this effect are known. When testing the stack quality, for example the alignment of the mail items on one or several edges or items of mail that are not lying flat one on top of another, e.g. are folded, are detected by a sensor and an evaluating unit with internal logic.

The named advantageous developments of the invention can be freely combined together.

BRIEF DESCRIPTION OF THE SEVERAL VIEWS OF THE DRAWING

The invention is described below with reference to the figures, in which, in detail.

DESCRIPTION OF THE INVENTION

Figure 1:
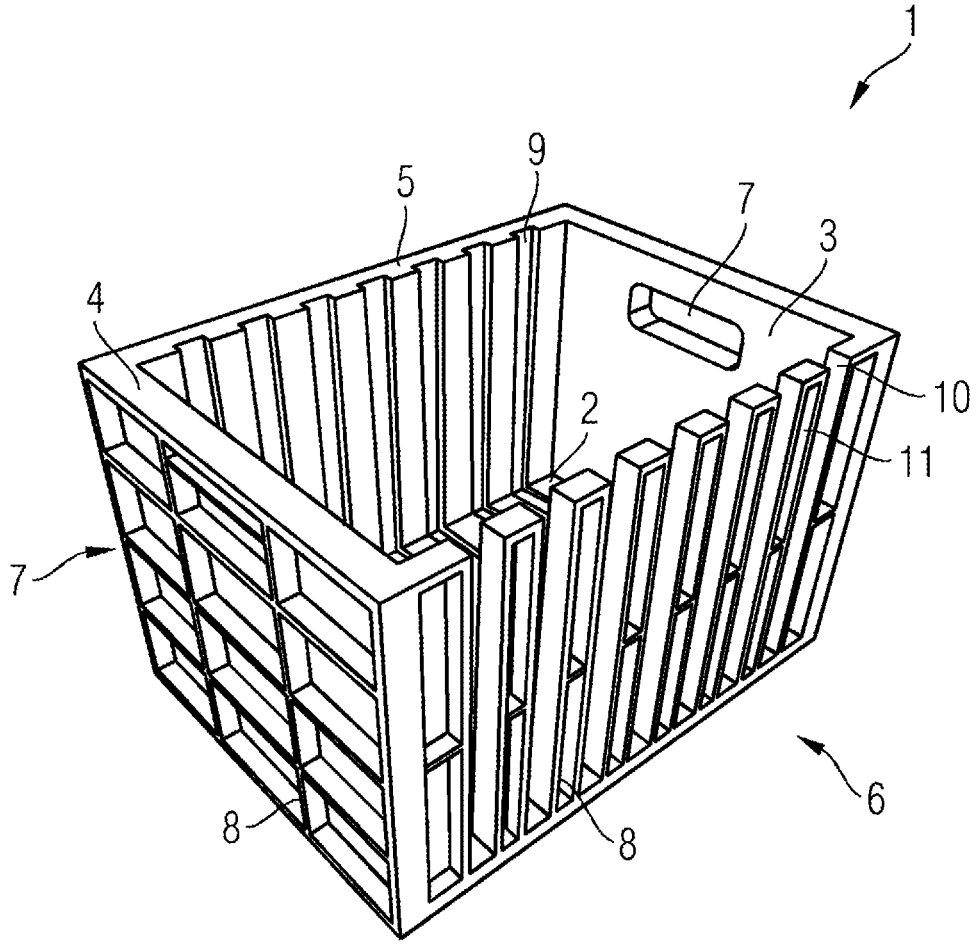
FIG. 1 shows a schematic representation of an exemplary embodiment of a conveying container according to the invention, in which a stack of flat mail items can be conveyed.

The conveying container 1 is described first of all with reference to the exemplary embodiment in FIG. 1.

The container 1 that is open at the top includes a bottom 2, two side walls 3, 4, a rear wall 5 and a front wall 6. The side walls, the rear wall and the front wall stand in each case vertically upright on the bottom 2, the side walls being arranged parallel to one another and the rear wall being arranged parallel to the front wall. Adjoining walls are in each case arranged at right angles to one another. A grip opening 7 is realized in each of the side walls 3, 4. The walls 3, 4, 5, 6 and the bottom 2 are developed in a thin-walled manner and comprise reinforcing ribs 8 for stabilizing purposes. The container in FIG. 1 is realized as an injection-molded plastics part.

In the interior of the container 1, the rear wall 5 comprises several grooves 9 which are each evenly spaced apart from one another. Said grooves 9 are also realized in the bottom 2. The grooves 9 have a rectangular cross section and extend in a substantially straight manner, in each case parallel to the side walls 3, 4. The front wall 6 includes several slot-shaped recesses 10 which are open at the top. The width of the recesses 10 corresponds substantially to the width of the grooves 9, recesses 10 and grooves 9 being realized in alignment with one another. The recesses 10 are open at the top such that as a result the front wall 6 is realized in the manner of a fork with a plurality of tines 11.

The container is part of the device according to the invention for handling a stack of flat mail items. The device is explained below by way of the exemplary embodiment in FIGS. 2 to 22.

The exemplary handling device 12 includes a container conveying system 13 with a lift unit 14, a further lift unit 23 and a presenting station 16, a rotary device 15, a feed device 17 with a storage region 18 and a separating-into-singles device 19, which provides a letter-sorting device 20 when operating with flat mail items 21.

Figure 2:
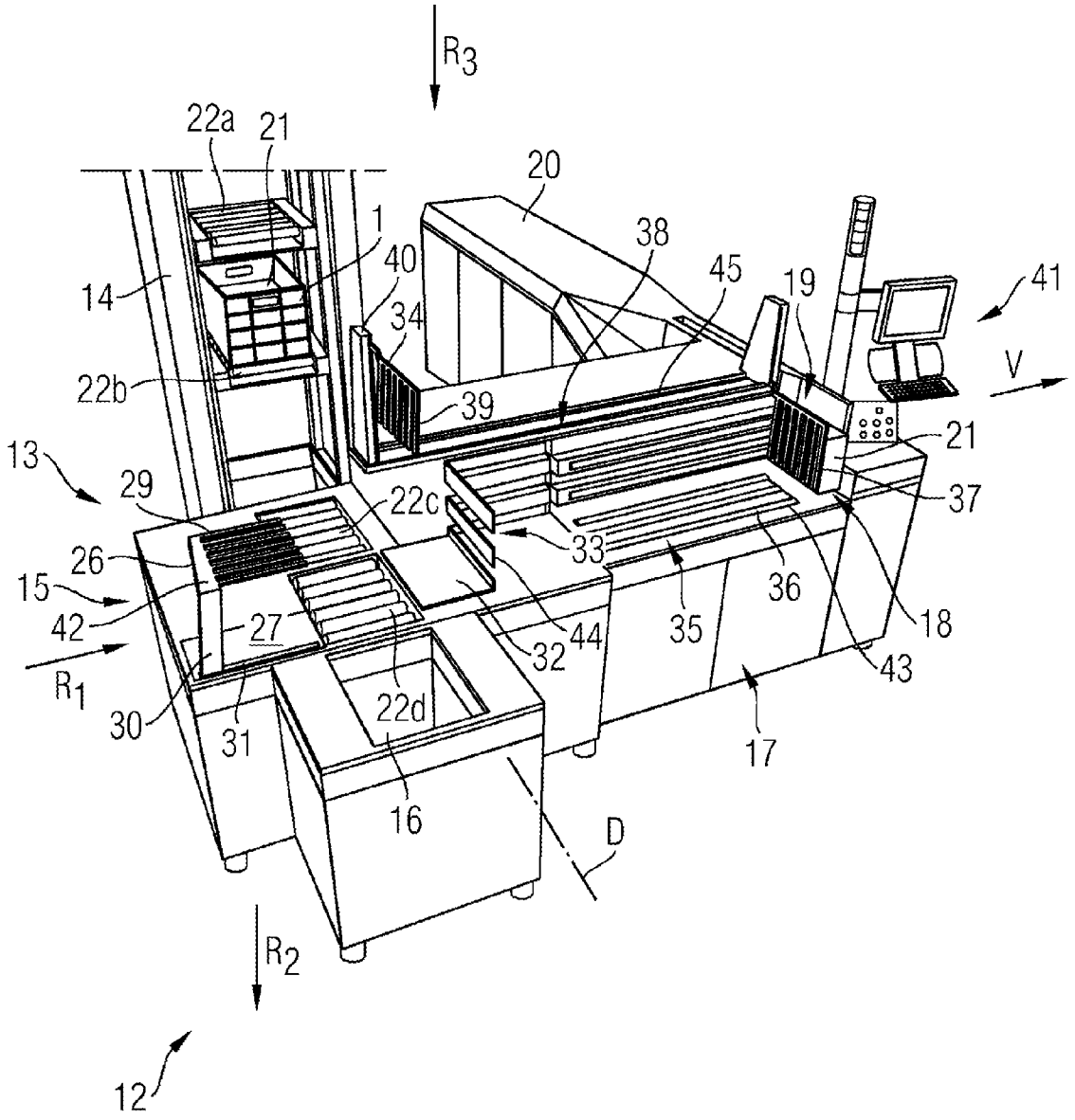
FIG. 2 shows a schematic representation of an exemplary embodiment of the device according to the invention for handling a stack of flat mail items.
Figure 3:
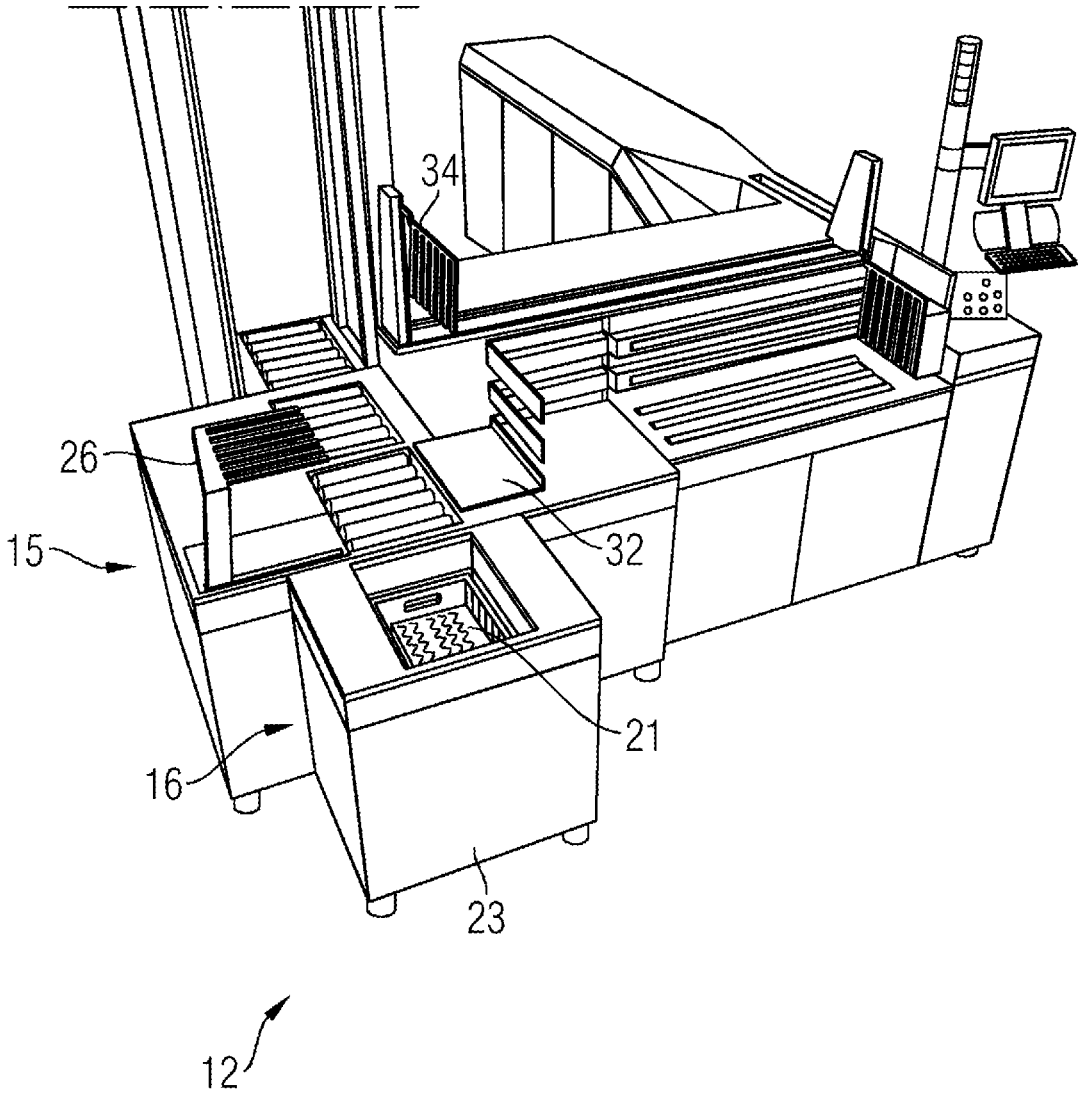
FIGS. 3 to 22 show the device from FIG. 2 in different positions.

The flat mail items 21, for example rectangular standard letters or large letters, are provided in the containers 1 from FIG. 1 in the case of the exemplary device 12 in FIG. 2. In this case, the mail items are situated in a starting orientation, in which the mail items lie substantially flat one on top of another. The flat mail items 21 are to be provided in a processing orientation, in which the mail items are arranged substantially standing side by side, on the feed device 17 which, in this case, as an example, supplies the separating-into-singles device 19. Said manipulation of the orientation of the flat mail items is carried out by the handling device 12 according to the invention and is described below. The separating-into-singles device 19 and the letter sorting device 20, in this case, are only as an example. The invention can also be used for other tasks.

The lift unit 14 of the container conveying system 13 includes several roller conveyor portions 22 which are arranged in each case one above another such that in each case a container 1 can be placed onto a roller conveyor portion 22. The roller conveyor portions 22 are coupled together and can be moved together in a vertical direction.

Outside the lift unit 14, further roller conveyor portions 22*c* and 22*d* are arranged in a first conveying plane. Further roller conveyor portions that are not visible in FIG. 2 are mounted below the roller conveyor portions 22*c* and 22*d* in a second conveying plane which is parallel to the first. For unloading the container 1 in FIG. 2, the lift unit 14 moves the roller conveyor portions 22*a* and 22*b* into the position shown in FIG. 3 such that the roller conveyor portion 22*a* is in alignment with the roller conveyor portions 22*c* and 22*d* and the roller conveyor portion 22*b* is in alignment with the further roller conveyor portions (not shown) in the second conveying plane. The container 1 can be conveyed by means of the second conveying plane as far as into a further lift unit 23 in this manner.

Figure 4:
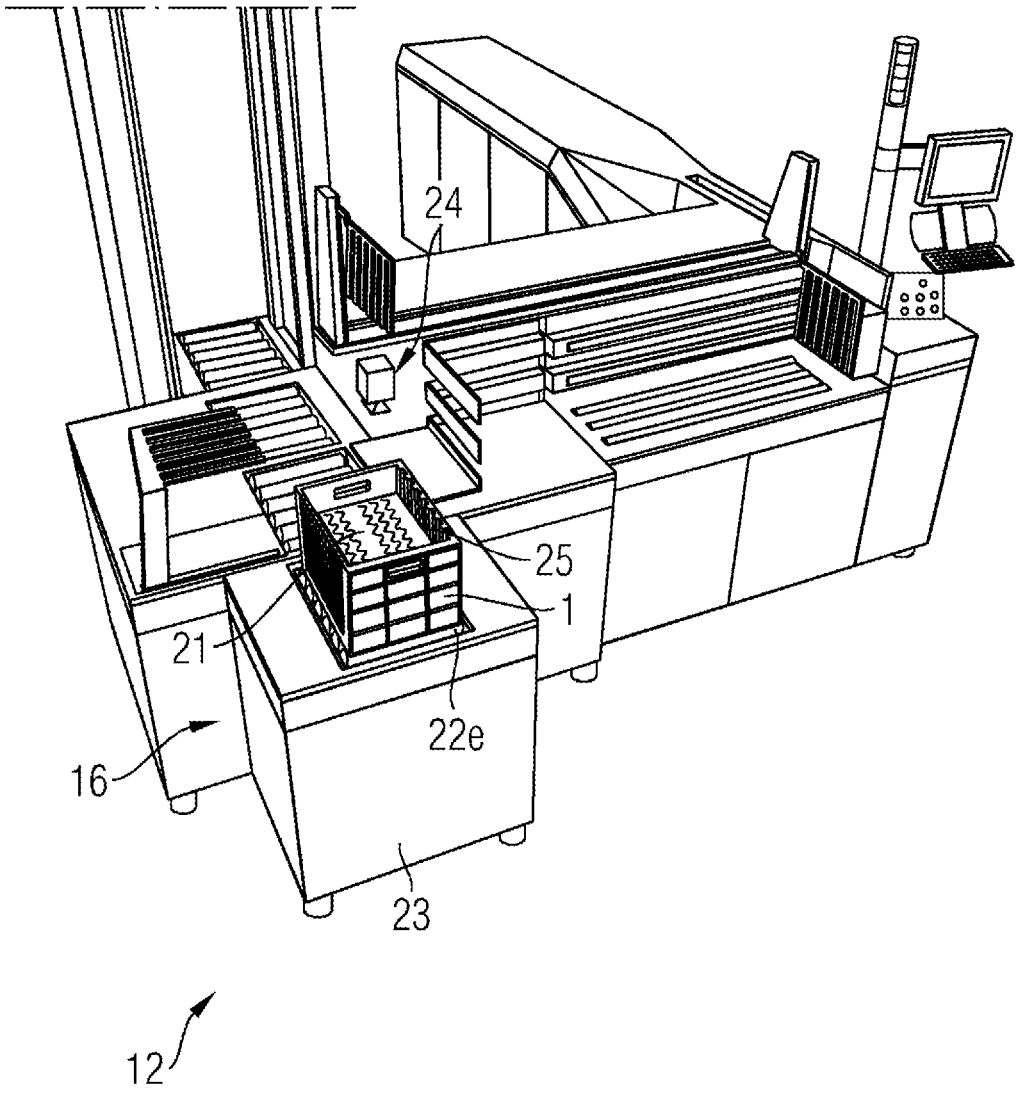

The further, smaller lift unit 23 just includes one roller conveyor portion 22*e* which can move from a bottom position, which is shown in FIG. 2, into a top position which is shown in FIG. 4. As shown in FIG. 4, the further lift unit 23 moves the container 1 with the mail items 21 into the top position which is part of the presenting station 16.

In the exemplary embodiment in FIG. 4, the presenting station 16 includes a camera 24 which is arranged above such that an image of the flat mail items 21 in the presenting station 16 or when they are moving upward in the further lift unit 23 can be taken. The camera 24 and a connected evaluating unit (not shown) with internal logic detect the stack quality of the mail items 21. The plurality of mail items 21 in the container 1 together form a stack 25. The camera 24 and the evaluating unit with the internal logic consequently detect the quality of the stack 25. As an alternative to this, any other type of sensor can obviously also be used to acquire the stack quality. The stack quality can also be detected at a different point prior to the presenting station 16. A quality index for the stack quality is determined by way of established criteria. If the quality index of the stack 25 falls below a certain value that is representative of the stack not being processable, the container 1 is stopped in the presenting station 16 and further processing in initially prevented.

In this case, the device 12 outputs a corresponding reference signal which shows an operator that the stack in the presenting station 16 has to be corrected manually. Said reference signal can be an acoustic and/or visible signal which emanates, for example, from a control panel 41. Once the stack has been manually corrected, processing is continued. It can be particularly advantageous to arrange the presenting station in a region in which an operator is already at the system. In this way, no additional operator is required such that no additional personnel costs accrue for the presenting station.

If the detected quality index of the stack 25 is above the determined value that is representative of the processability of the stack 25, the processing of the stack 25 the conveying of the container 1 is continued without delay in the presenting station 16.

Figure 5:
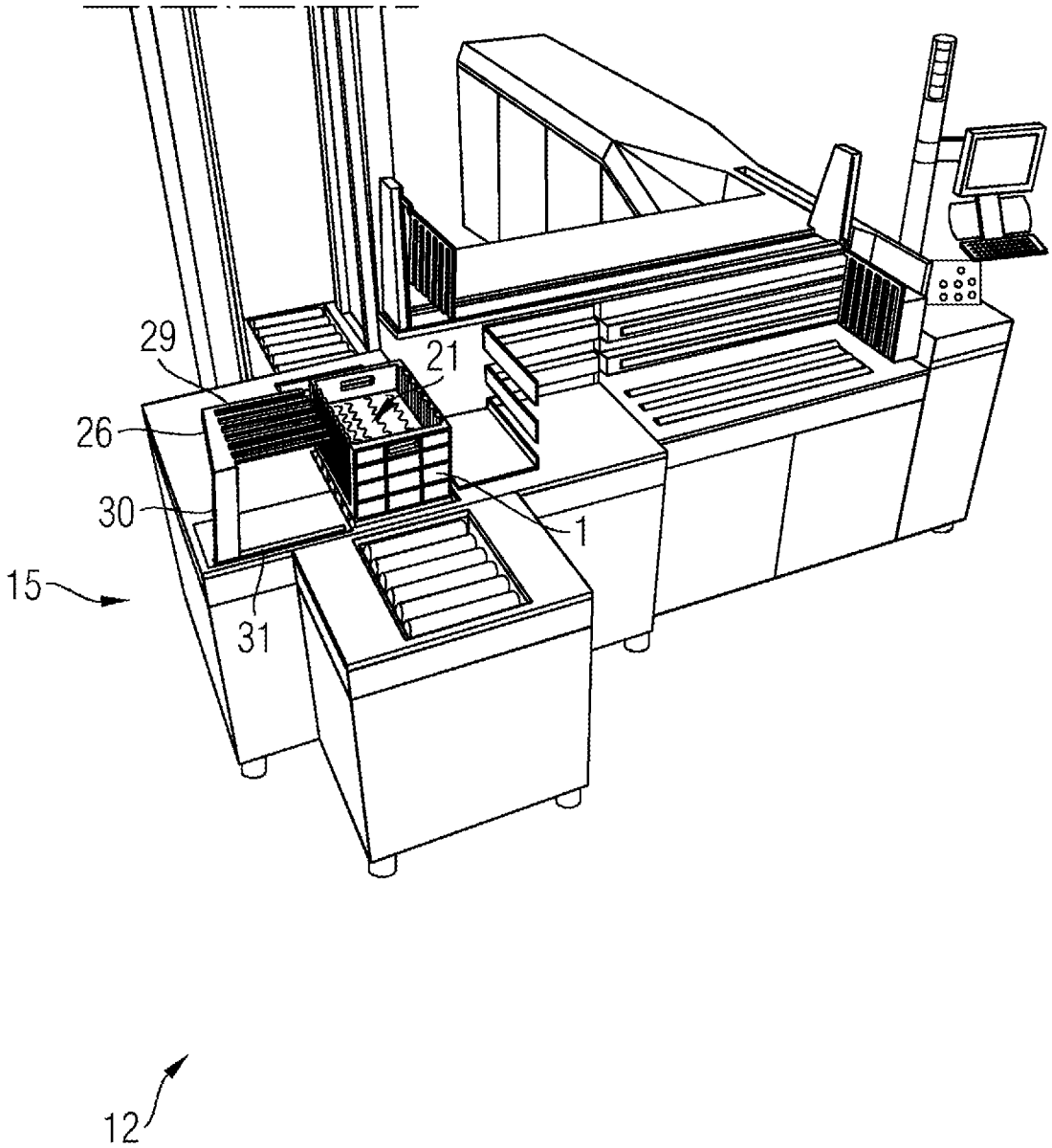

The container 1 is moved from the presenting station 16 to the roller conveyor portion 22*d* of the rotary device 15, as shown in FIG. 5.

The container conveying system 13 with the lift unit 14, the further lift unit 23 and the presenting station 16 only represent one exemplary possibility of how the container 1 can be conveyed to the rotary device 15. As an alternative to this, container conveying systems without lift units and without roller conveyor portions are obviously conceivable, as are known in the prior art. As an alternative, the detecting of the stack quality can also even be effected during the loading of the container 1 or shortly thereafter. The evaluating of the stack quality by the sensor 24 and the evaluating unit and the downstream presenting station 16 provide an independent invention which is also able to be used without the usual handling device 12.

The rotary device 15 comprises a holding means 26, a housing 27, the roller conveyor portion 22*d*, a basic frame 28 as well as various drive means 9 (not shown). The roller conveyor portion 22*d*, the holding means 26 and the housing 27 are arranged so as to be pivotable about an axis of rotation D that in this case is fixed in position in relation to the stationary basic frame 28. A rotary device 15 where the position of the axis of rotation D is modifiable is also conceivable. In the horizontal position of the rotary device 15 shown in FIG. 2, the roller conveyor portion 22*d* is aligned horizontally and in the first conveying plane. In a vertical position of the rotary device 15 shown in FIG. 8, the roller conveyor portion 22*d* is aligned vertically and at right angles to the first conveying plane.

The holding means 26 comprises a fork-shaped or comb-shaped portion which comprises several tines 29 which are arranged parallel to one another. The tines 29 are in each case mounted at right angles on a web 42 of the holding means 26. The number of tines 29 corresponds to the number of recesses 10 in the container 1. The width of the tines 29 is somewhat smaller than the width of the recesses 10 such that the tines 29 can be inserted easily and also in a process-reliable manner in the recesses 10 of the container 1. The length of the tines 29 is ideally longer than the length of the side walls 3, 4 of the container 1 such that the tines 29 can be pushed into the container 1 as far as into the grooves 3 in the rear wall 5. The holding means 26 additionally comprises a straight arm 30 which is arranged at right angles to the web 41, by means of which arm the holding means 26 is connected to a drive (not shown) in the interior of the housing 27. The arm is mounted on the one side of the web 41. The holding means 26 can be moved in two directions of movement $R_1$ and $R_2$ by means of the drive means. In the first direction $R_1$ the arm 30 and consequently the holding means 26 is moved along a guide slot 31. In the second direction $R_2$ which is at right angles to the direction $R_1$ the spacing between the tines 29 and the first conveying plane is reduced. The tines 29 extend parallel to the first conveying plane. The directions $R_1$ and $R_2$ are to be understood here in a horizontal position of the rotary device, as shown in FIG. 2.

The feed device 17 includes a conveying tray 32, a tray support means 33, a conveying support means 34, a horizontal feed bed 35 which extends in the first conveying plane, conveying means 36, the storage region 18, a storage support means 37 and a rear wall 39 which is arranged at right angles to the feed bed 35.

The feed bed 35 is aligned in a substantially even and horizontal manner and includes several slots 43 which extend in a feed direction V and in which the transport means 36 are arranged. The feed direction is defined as a direction that is remote from the rotary device 15. The conveying means 36 can be, for example, conveyor spindles or conveyor belts. The rear wall 38 is arranged substantially at right angles to the feed bed 35. The rear wall 38 serves as additional support means for the stack 25 during conveying in the feed direction and can also comprise conveying means.

The conveying tray 32 is realized in a substantially even manner as a rectangular plate, parallel to the feed bed 35 and can be moved in the feed direction V and in opposition to the feed direction V relative to the feed bed 35. In this case, there is always at least one small spacing to the feed bed 35 and the conveying means 36. The conveying tray 32 is driven in the feed direction by means of a drive (not shown)

which is arranged, for example behind the rear wall 38 and is connected to the conveying tray.

The tray support means 33 comprises several parallel strips 44 which extend horizontally and is realized at right angles to the conveying tray 32 and, in the form of the exemplary realization in FIG. 2, is connected to the conveying tray 32. The strips 44 define a support plane which extends at right angles to the first conveying plane. The tray support means 33 is guided so as to be longitudinally movable with respect to the rear wall 38.

The conveying support means 34 is arranged parallel to the tray support means 33 and, similar to the holding means 26, is realized in a fork-shaped manner with tines 39 which extend parallel to one another. The tines 39 are realized in the same manner as the tines 29 of the holding means 26 such that they are easily able to engage into the recesses 10 of the container 1. The tines 39 extend at right angles to the strips 44. The conveying support means 34 is connected to a linear guide means 40 and a drive (not shown), by means of which the conveying support means 34 is movable from a top position shown in FIG. 2 into a bottom position in the direction $R_3$. $R_3$ extends at right angles to the conveying tray 32 and to the feed direction V. The conveying support means 40 is movable by means of a further linear guide means 45 and a further drive (not shown) in the feed direction V and in opposition to the feed direction V such that the conveying support means 34 and consequently the tines 39 of the conveying support means 34 can be moved both in the vertical direction and in the horizontal direction.

The storage support means 37 is realized in a fork-shaped manner similar to the conveying support means 34 and can also be moved in the feed direction V, that is horizontally, and also vertically between a top position and a bottom position in the direction $R_3$.

The separating-into-singles device 19 used here as an example is realized in a known manner and includes a vertically extending feed conveyor which conveys mail items 21 at the end of the storage region 18 into the letter sorting device 20, which is also used as an example here.

The handling of a stack 25 of flat mail items 21 in the device 12 according to the invention 12 is described below.

As already described above, the stack 25 is provided in the container 1, if the stack quality is in order, on the roller conveyor portion 22*b* of the rotary device 15. The stack 25, in this case, is in the starting orientation in which the mail items 21 lie substantially flat one on top of another—that is are horizontally aligned. Said state and the position of the container 1 are shown in FIG. 5. The rotary device is in the horizontal position—a first position.

Figure 6:
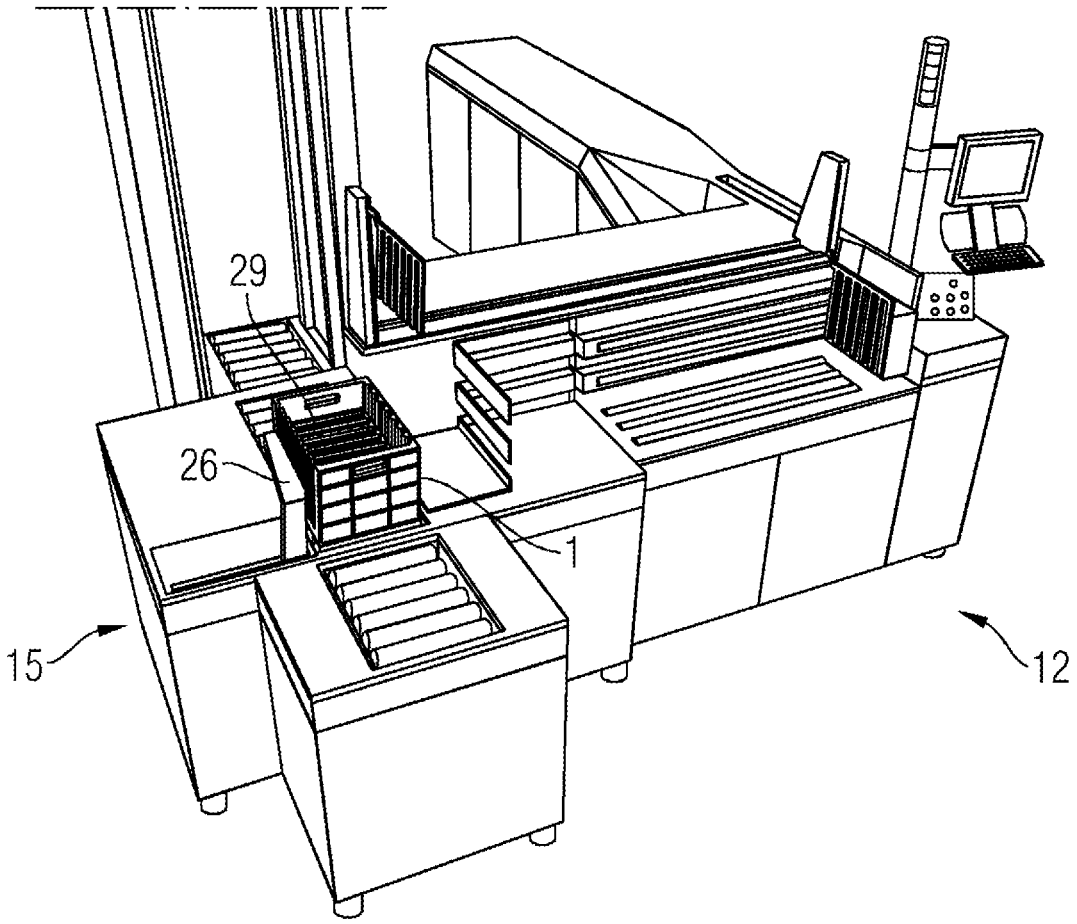

The holding means 26 then moves initially in the direction $R_1$—that is horizontally until the fork-shaped strips 29 are arranged above the stack 25. The holding means 26 then move downward in the direction $R_2$—that is vertically until the tines 29 press down onto the stack in the vertical direction. A predetermined holding force can be built up here for example. The stack 25 secured in this manner by the holding means 26 in the container 1 is shown in FIG. 6. The holding means 26 has the function of a hold-down means.

Figure 7:
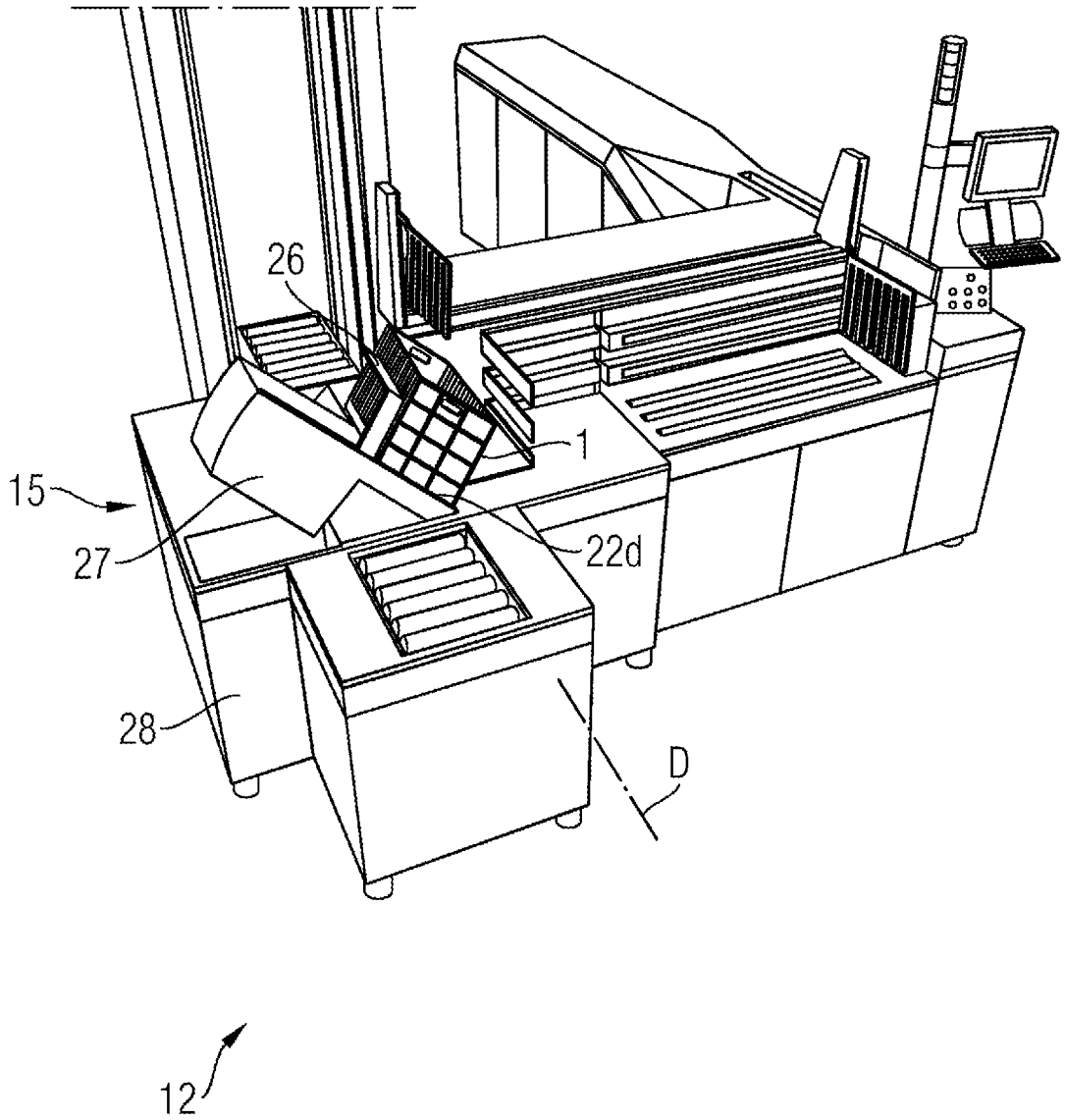
Figure 8:
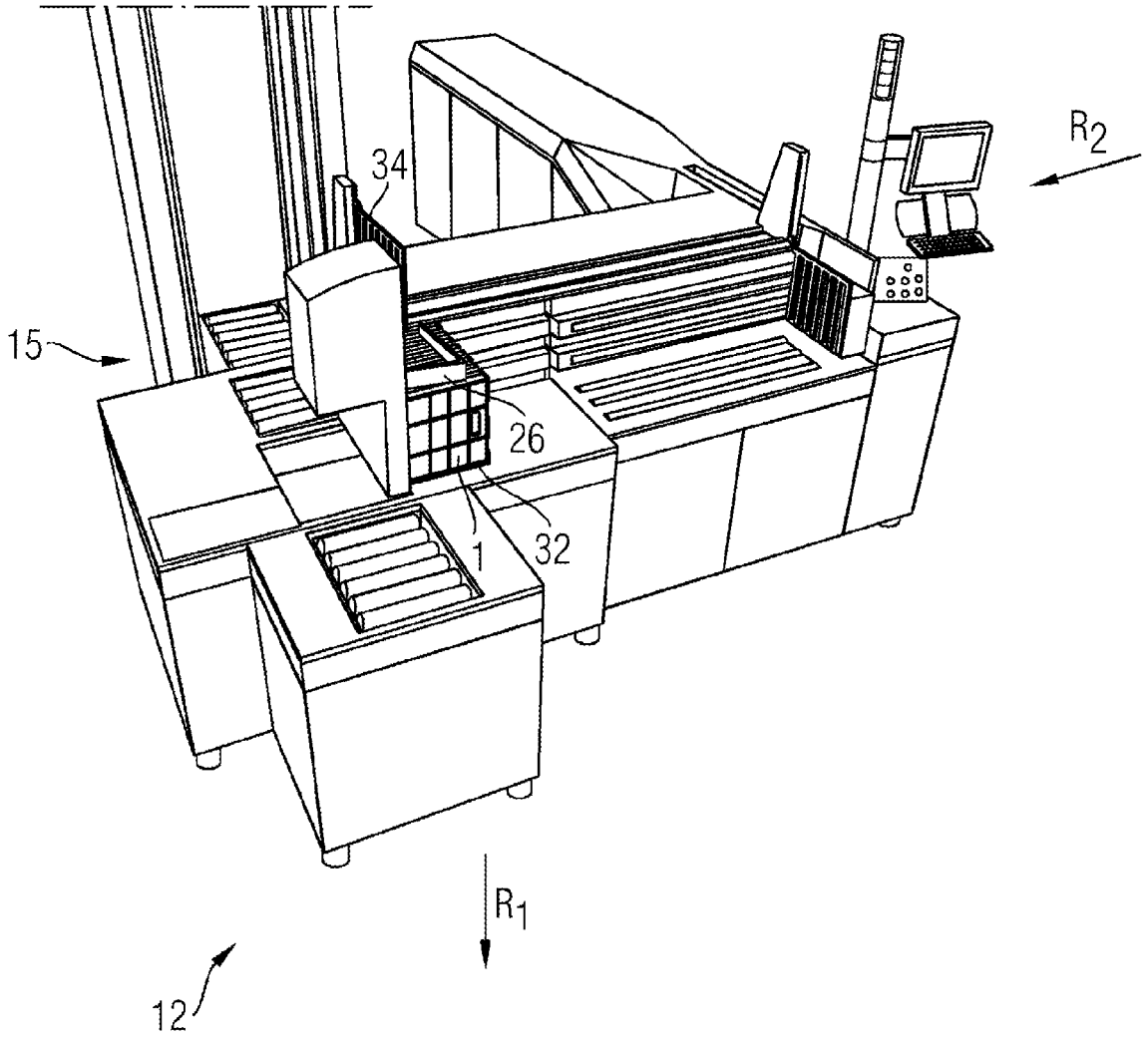

As shown in FIG. 7, the rotary device 15 then rotates from its horizontal position—first position—in FIG. 6 by about 90° into the vertical position—second position, which is shown in FIG. 8. In the horizontal position of the rotary device 15, the received stack is in the starting orientation, in the vertical position it is in the processing orientation. In the vertical position, the directions $R_1$ and $R_2$ have altered in a corresponding manner, as shown in FIG. 8. The stack 25, secured by the holding means 26, has been rotated from the starting orientation into the processing orientation in this manner.

When the rotary device 15 is rotated, the conveying tray 32 is situated in its maximum position in opposition to the feed direction V—its initial position. In the initial position, the spacing between the conveying tray 32 and the roller conveyor portion 22*d* is minimal such that the container 1 is placed onto the conveying tray 32 during rotation. In the vertical position of the rotary device 15, the side walls 3, 4 of the container 1 are consequently parallel to the conveying tray 32. The conveying support means 34 is also situated in its initial position in which it is in the maximum position in opposition to the feed direction V and in its top position. In the initial position, the spacing in the feed direction V between the roller conveyor portion 22*d* and the conveying support means 34 is minimal. The conveying support means 34 is positioned in the initial position such that the tines 39 are parallel with the now vertically upright bottom 2 of the container 1 and above and in alignment with the grooves 9 in the bottom 2 of the container.

Figure 9:
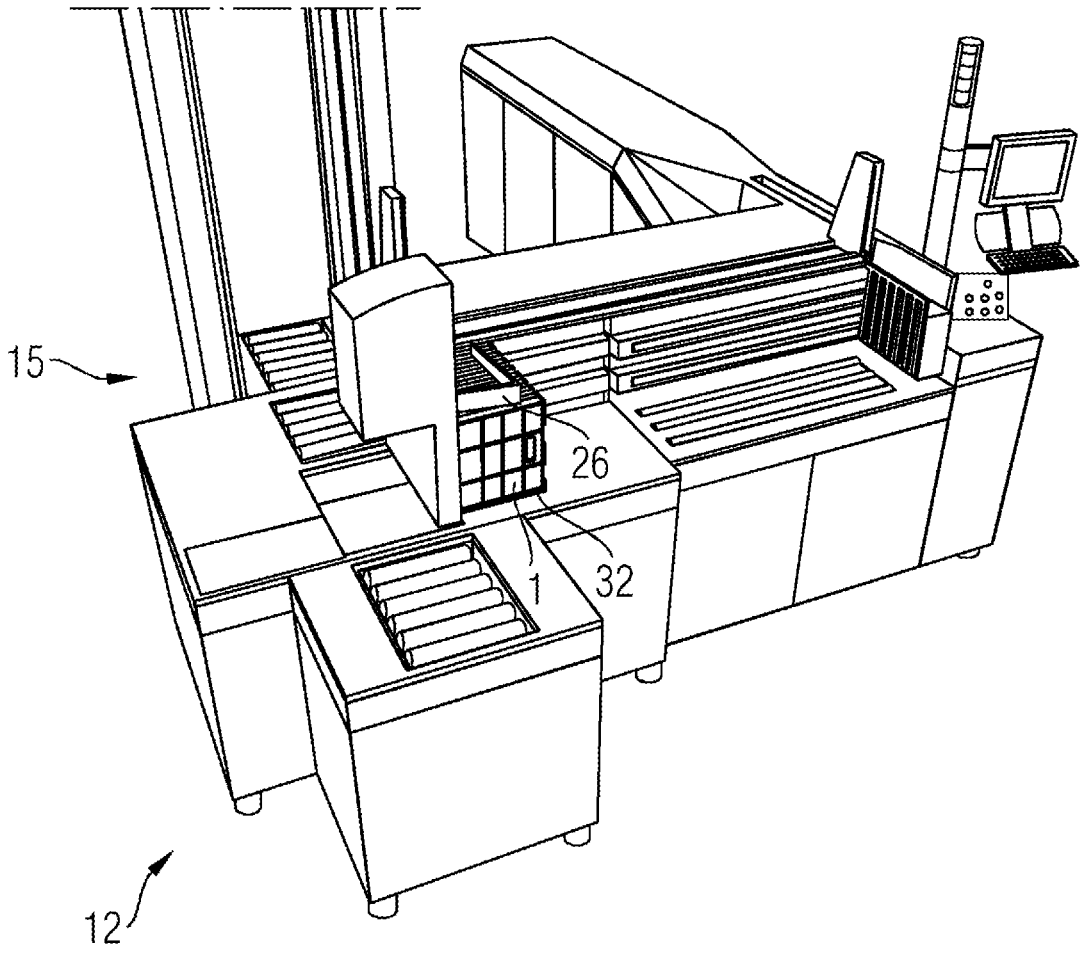

As shown in FIG. 9, the conveying support means 34 then moves in the direction $R_3$ into its bottom position such that the tines 39 enter into the recesses 10 of the container 1 and the grooves 9 thereof which are situated next to the mail items 21. An undercut is made possible as a result of the grooves 9, this means that the strips of the conveying support means 34 move into the container 1 without having been able to damage the mail items.

The conveying support means 34 and the holding means 26 have now gripped the stack 25 at the front and at the back, when viewed in the feed direction V.

Figure 10:
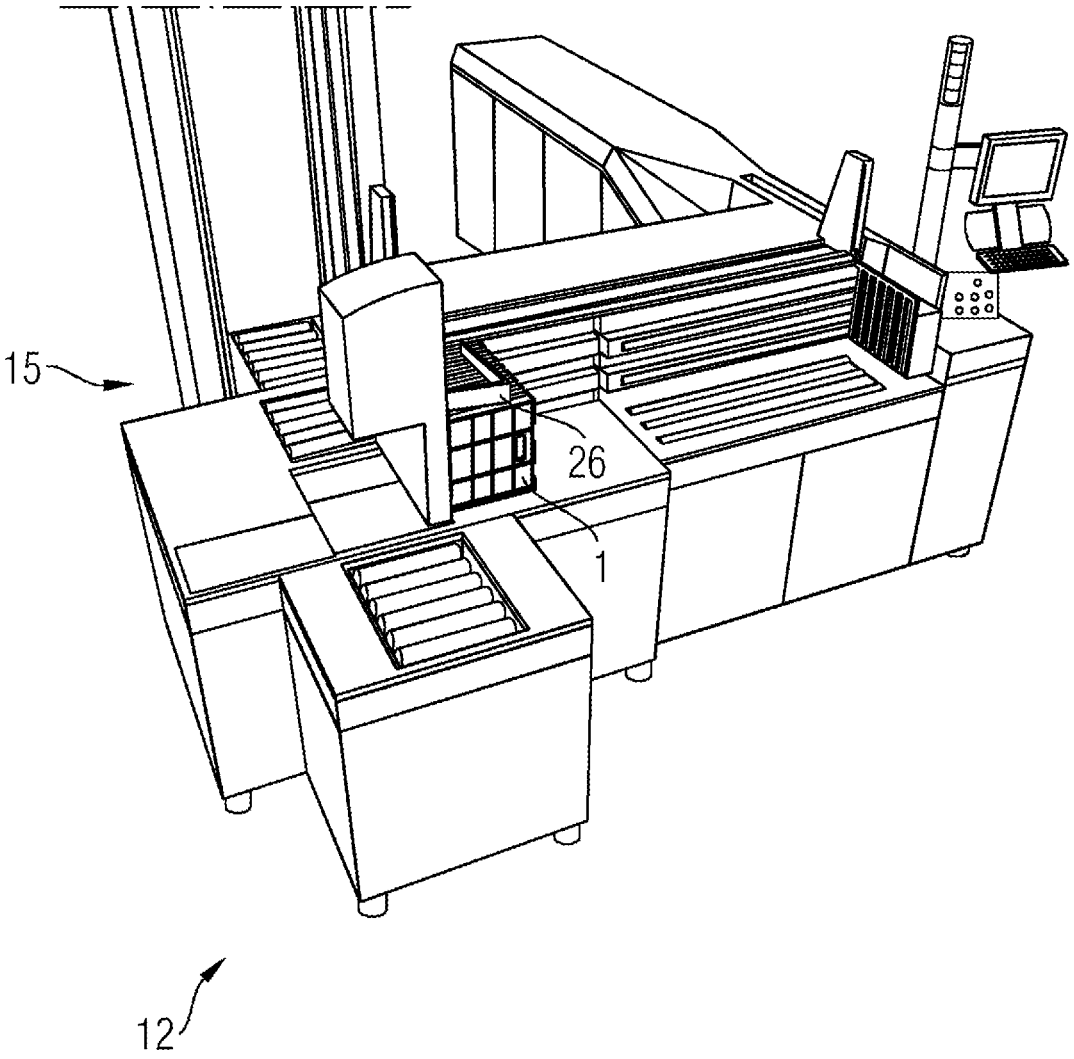

The conveying support means 34 and the holding means 26 then move at the same time in parallel in the feed direction V approximately up to the end of the container 1 until the holding means 26 contacts the tray support means 33, for instance, as shown in FIG. 10.

Figure 11:
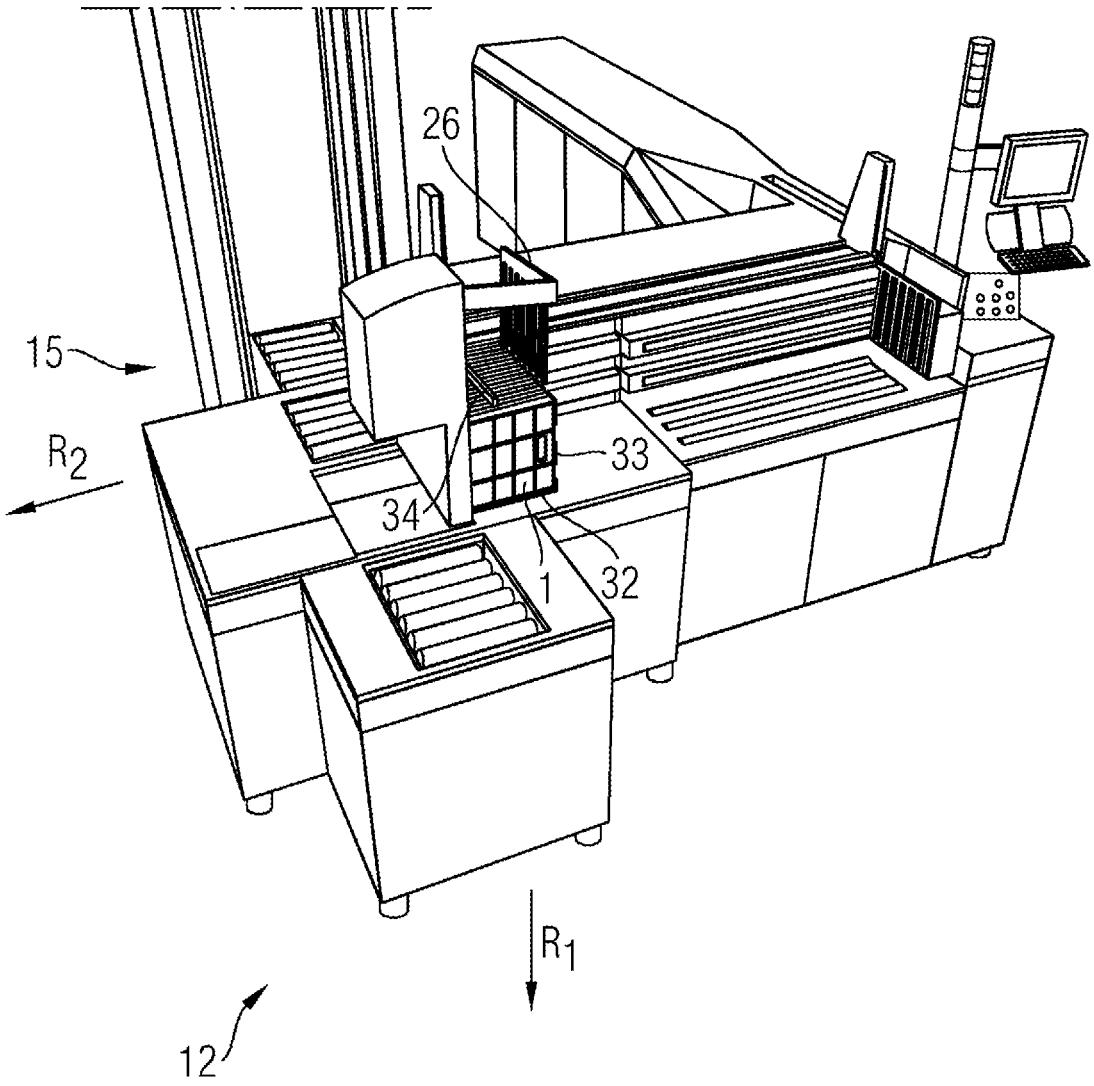

As shown in FIG. 11, the holding means then moves upward in the vertical direction in opposition to the direction $R_1$ with the tines 29 parallel to the bottom 2.

Figure 12:
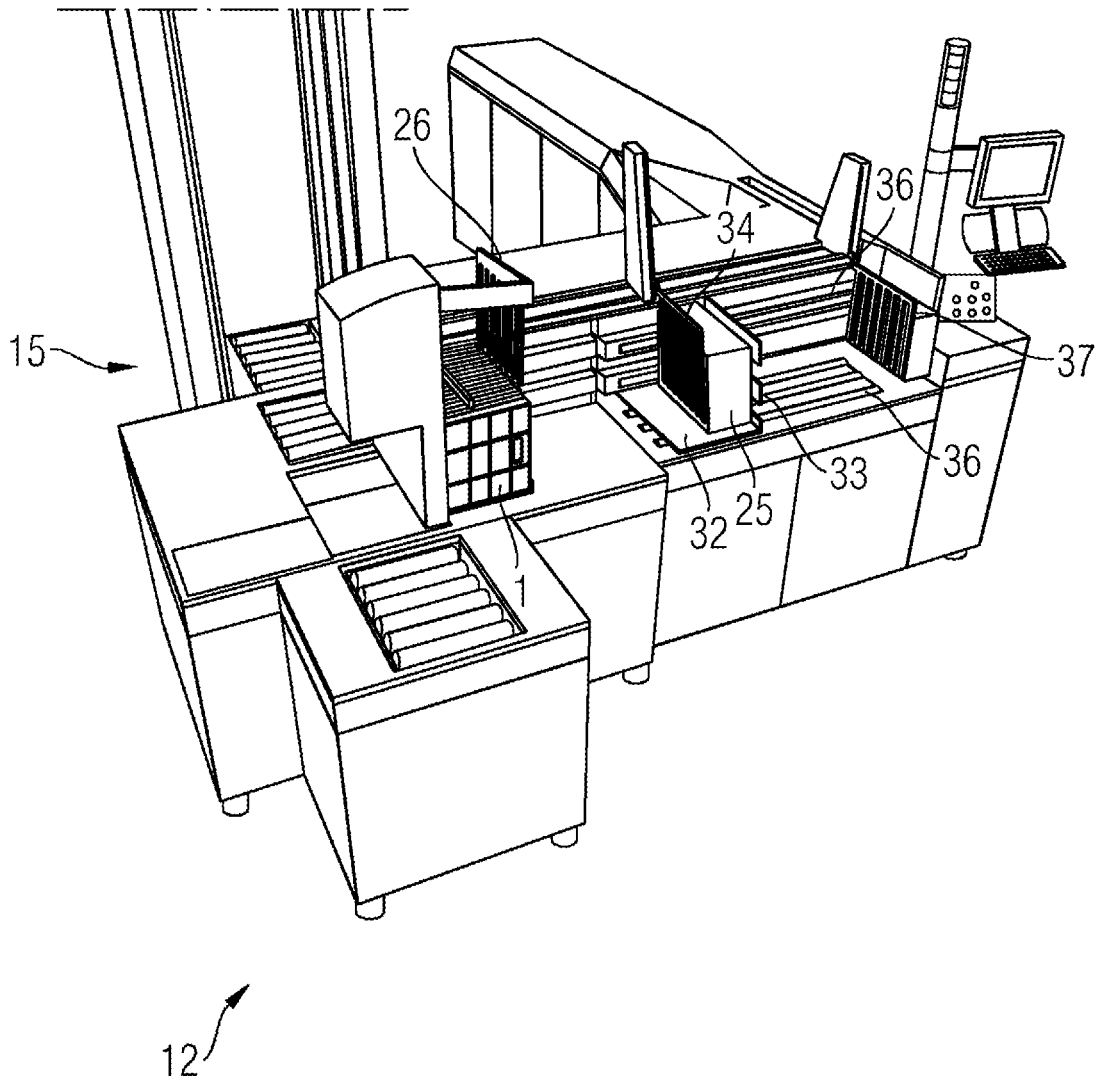

The stack 25 continues to be supported from two sides against falling, now however by the conveying support means 34 and the tray support means 33. The tray support means 33, the conveying support means 34 and the conveying tray 32 then move in a synchronous manner in the feed direction V such that the stack 25 is moved in the processing orientation into the storage region 18, as shown in FIG. 12. The conveying tray 32 provides an intermediate storage means in which the stack 25 is received.

Figure 13:
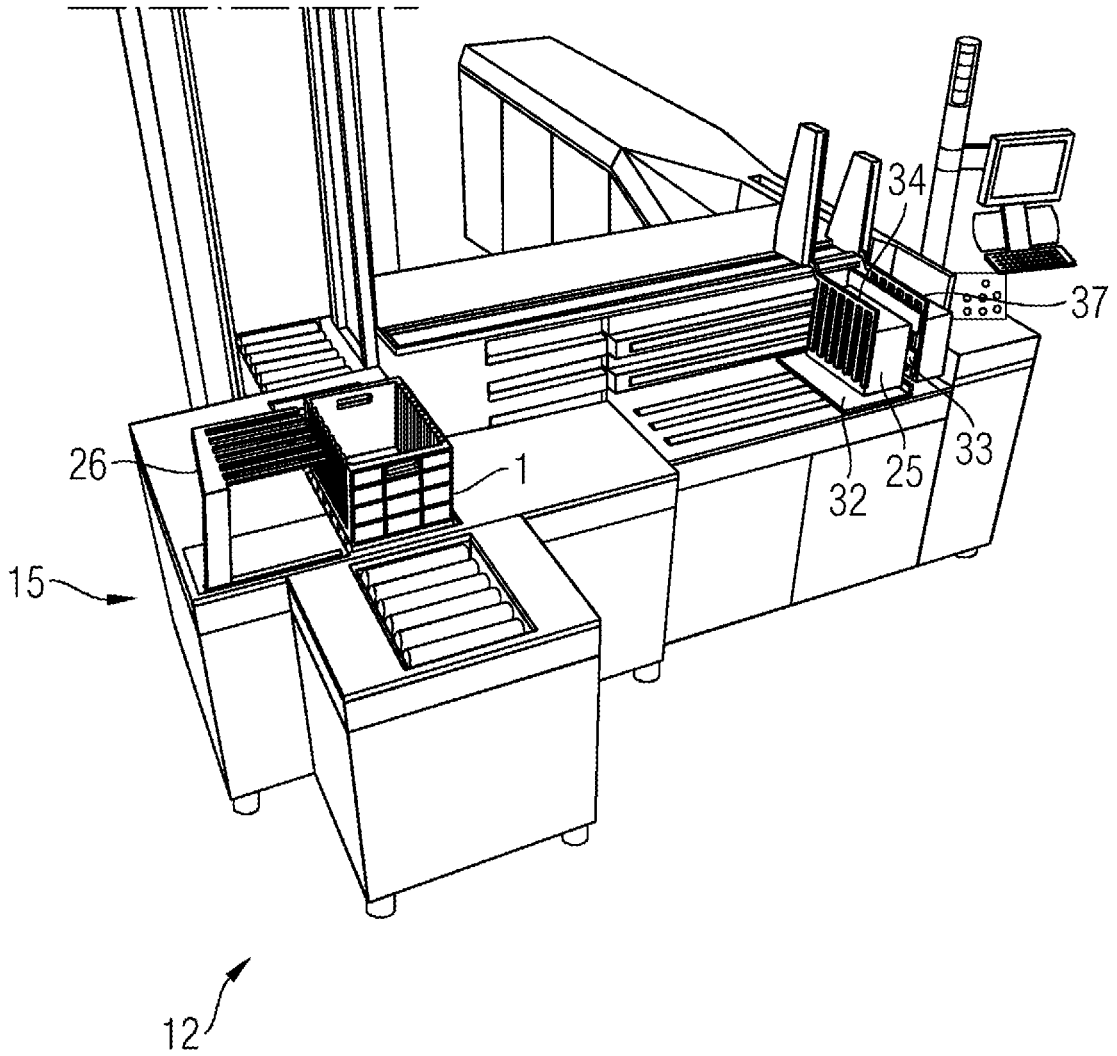

When the stack 25 is moved in the direction of the storage region 18, the rotary device 15 is already rotating back into its horizontal position. In this case, the container 1 is held by the holding means 26 which, prior to the rotating back, has been moved up to the end of the recesses 10. At the same time, the stack 25 is moved so far in the feed direction V until the tray support means 33 substantially contact the storage support means 37 (as shown in FIG. 13). The emptied container 1 is conveyed away by the container conveying system 13.

Figure 14:
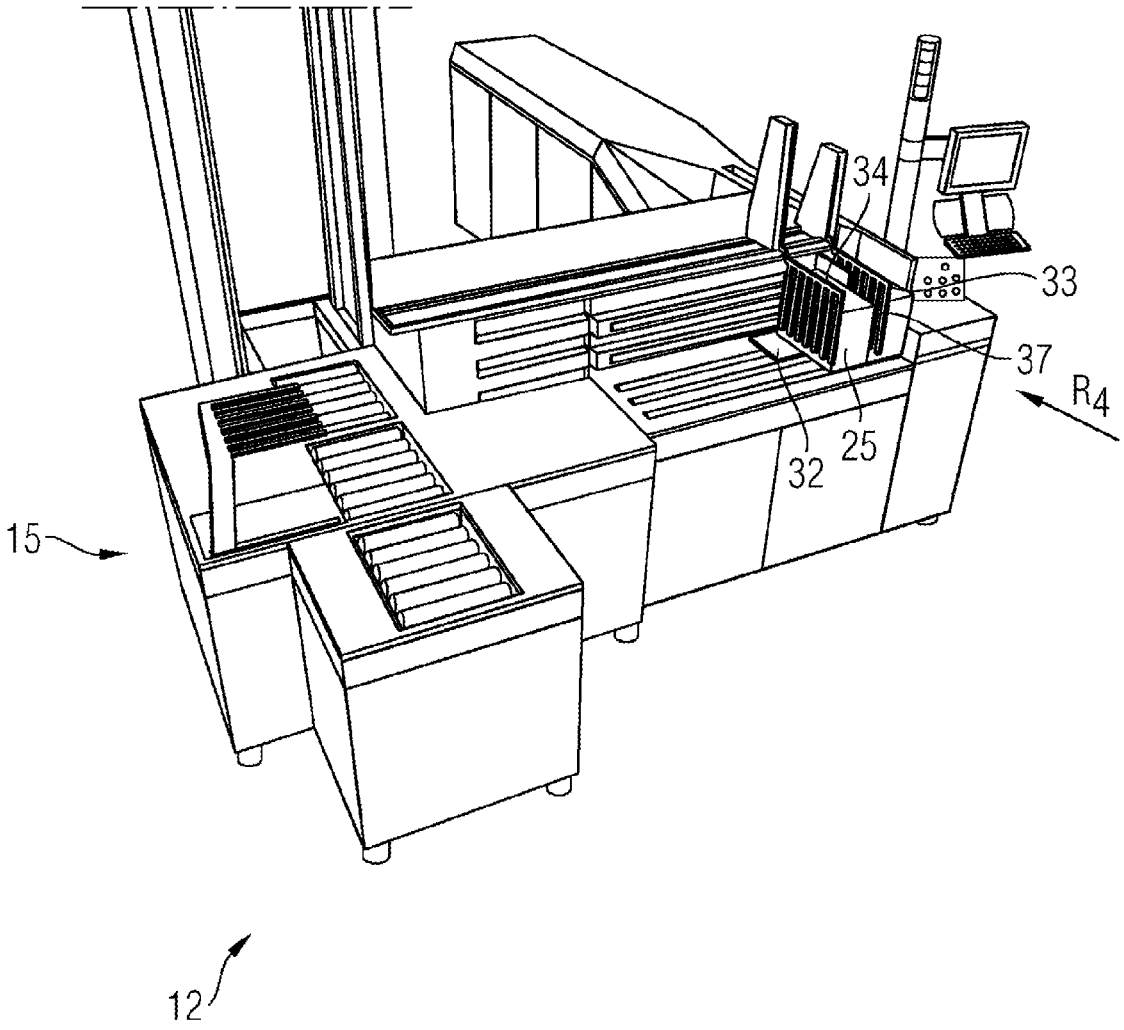
Figure 15:
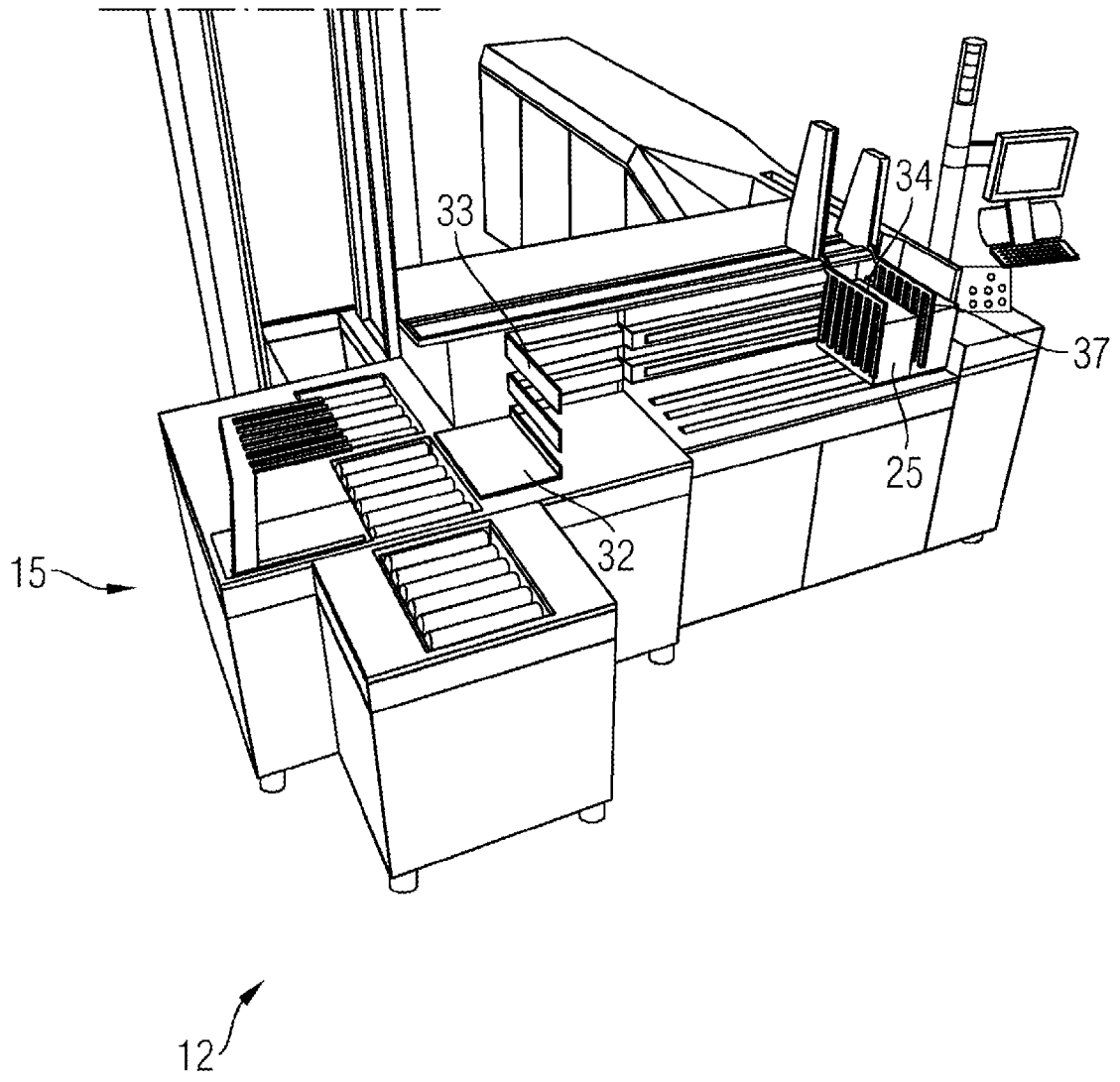

The conveying tray 32 and the conveying support means 34 are then or in parallel moved together out of the feed bed 35 transversely with respect to the feed direction V in the direction $R_4$. The stack 25 is thus only still held between the conveying support means 34 and the storage support means 37. FIG. 14 shows how the conveying tray 32 and the tray support means 33 are moved in the direction $R_4$. The conveying tray 32 and the tray support means 33 then move back into their initial positions (as shown in FIG. 15).

Figure 16:
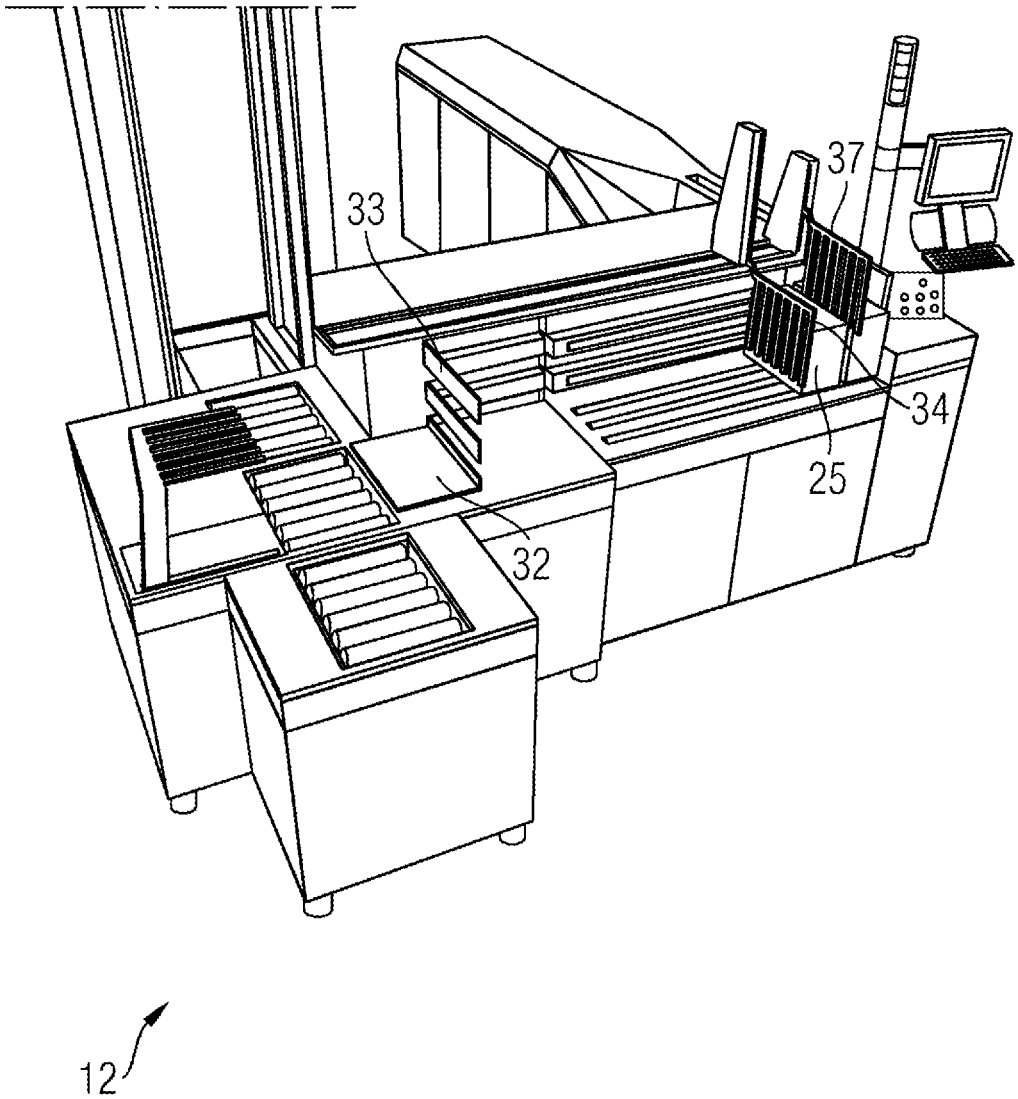
Figure 17:
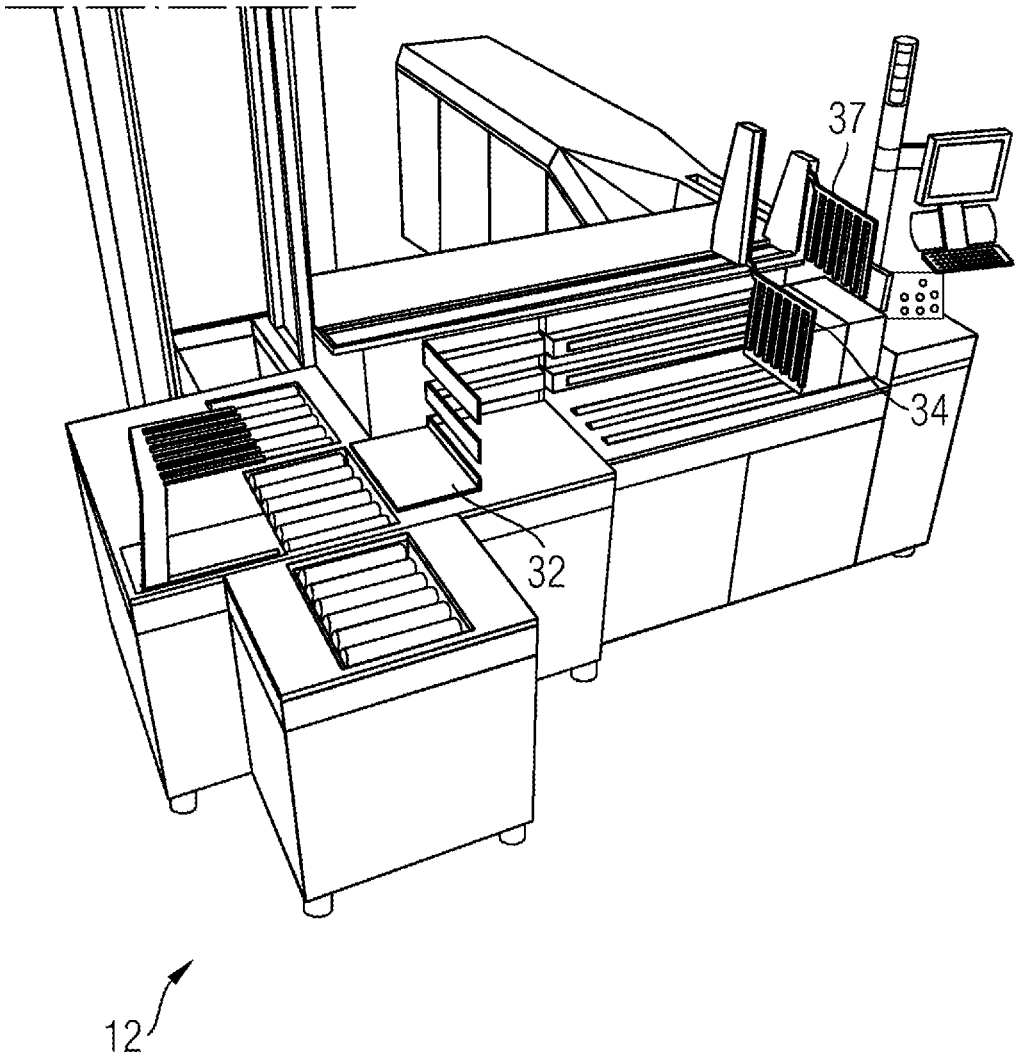

In order then to join the stack 25 with the remaining mail items 21 in the storage region 18, the storage support means 37 moves into its top position, as shown in FIGS. 16 and 17.

Figure 18:
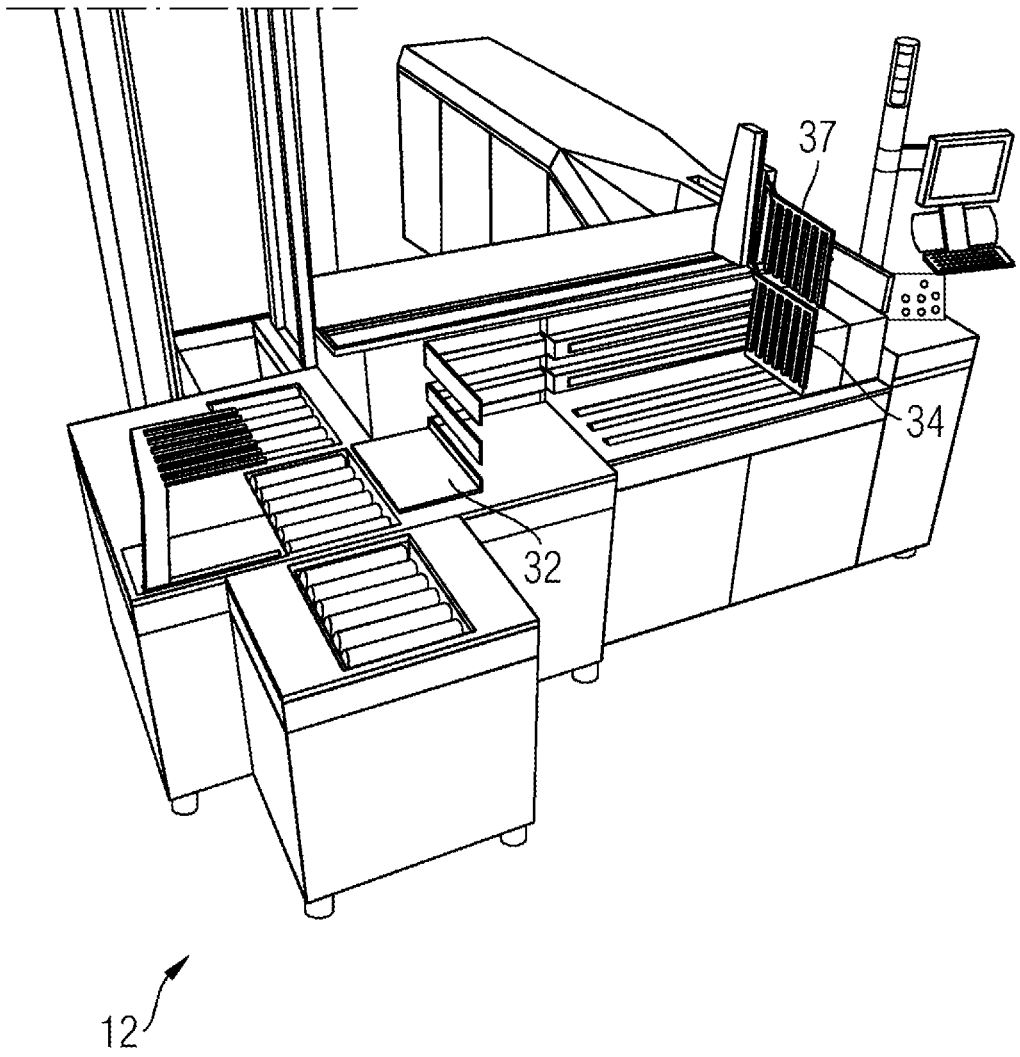
Figure 19:
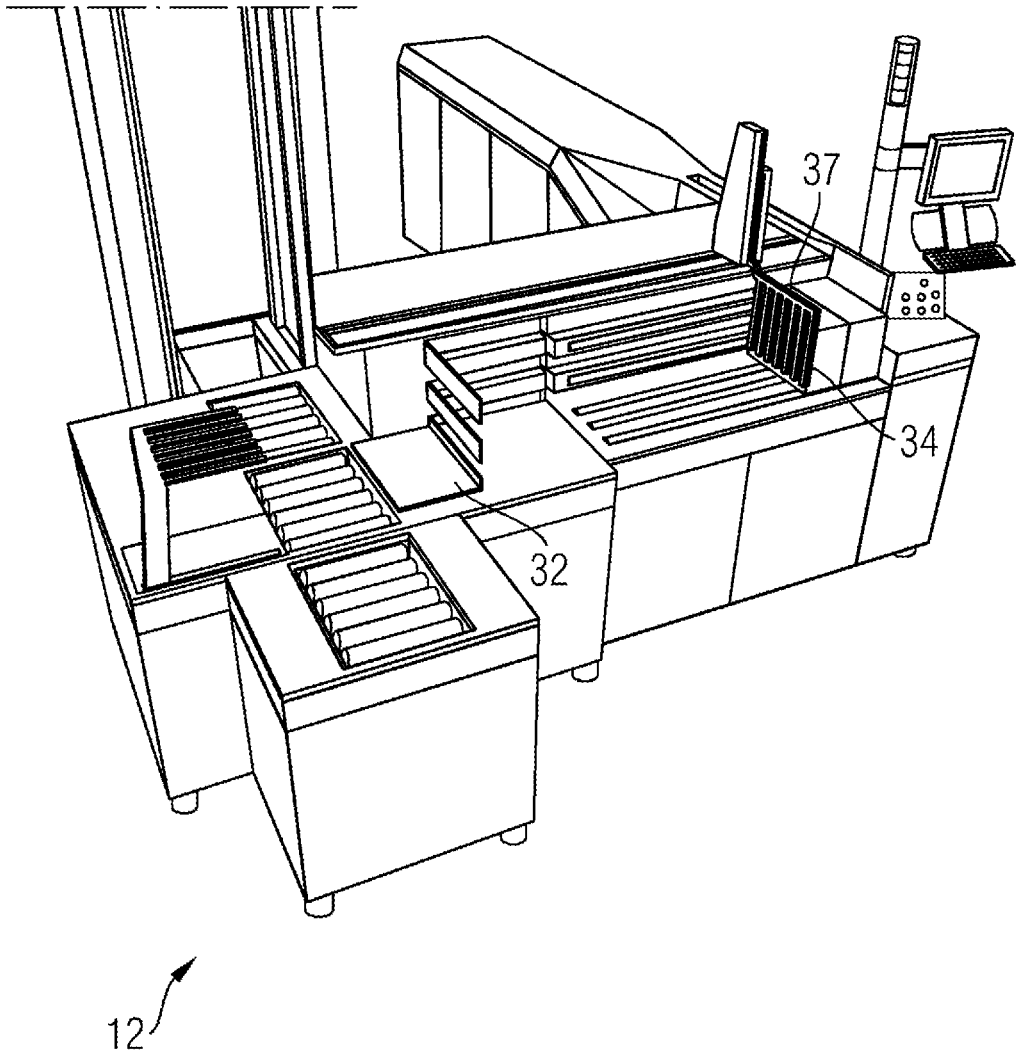
Figure 20:
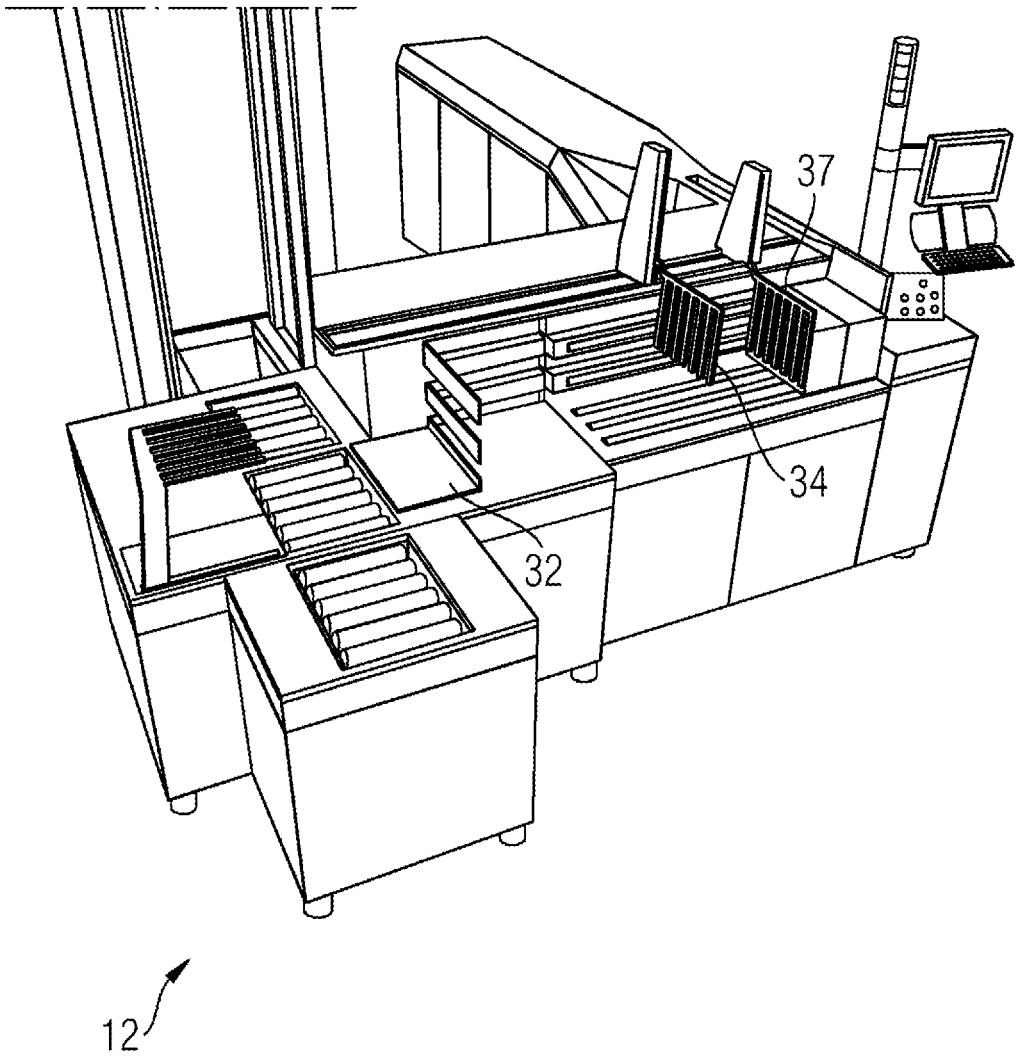
Figure 21:
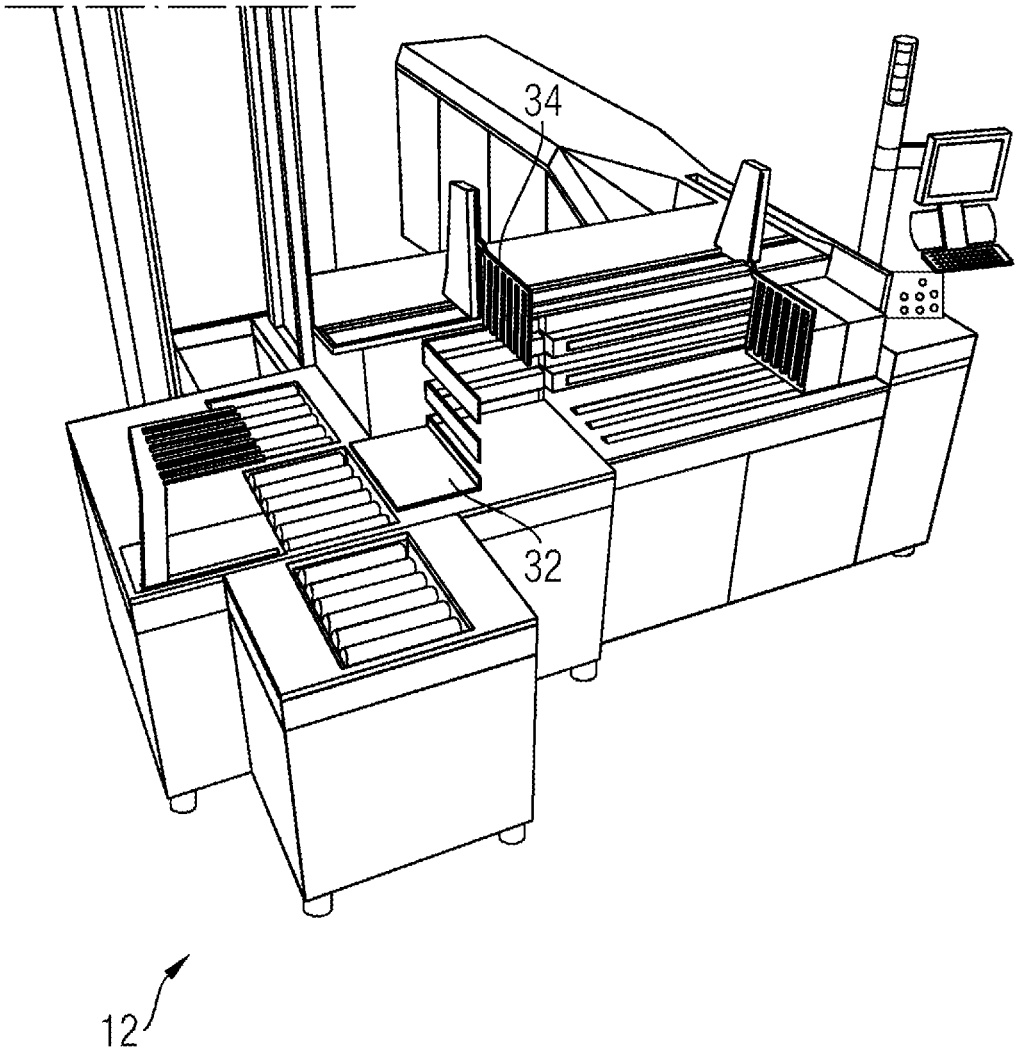
Figure 22:
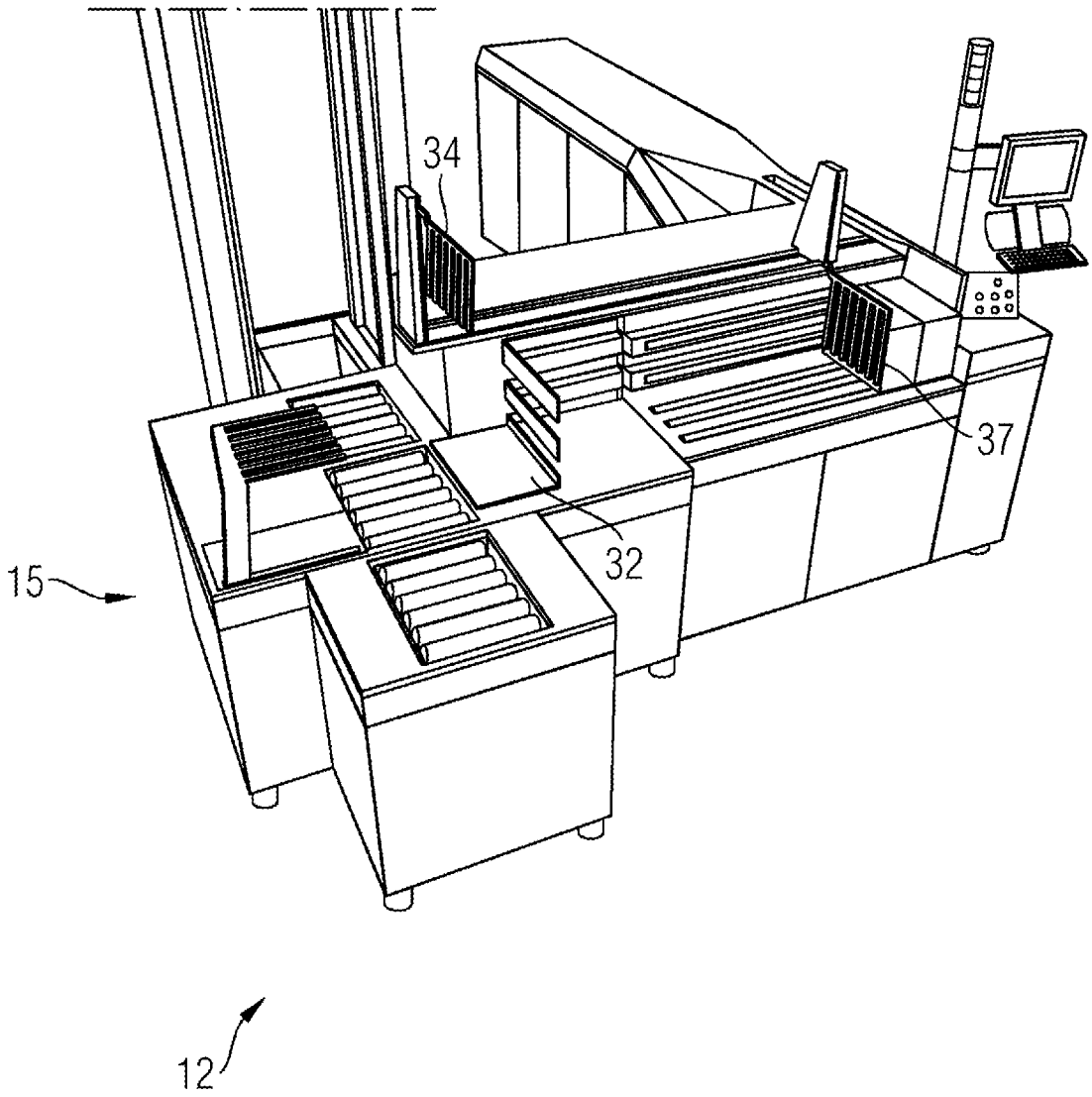

The storage support means 27 moves in front of the conveying support means 34 in the feed direction V in FIG. 18 and moves, as shown in FIG. 19, into its bottom position. The conveying support means 34, as shown in FIG. 20, can then move back into its initial position, as shown in FIGS. 21 and 22. The next stack, which the rotary device has already rotated and placed on the conveying tray 32, can be processed in this manner.

The invention claimed is:

1. A device for the automated handling of a stack of flat mail items, the device comprising:

a container for delivering the stack of flat mail items, with the mail items lying flat on one another in said container;

said container having an open top and a sidewall formed with a plurality of recesses, said recesses being elongated slots that are open at the top;

a rotary device configured to rotate the container with the stack during operation from a starting orientation to a processing orientation, the mail items lying flat on one another in the starting orientation and the mail items substantially standing side by side in the processing orientation;

a holder configured to fix the stack when rotating, said holder having a plurality of tines configured for insertion into said recesses in the sidewall of said container, with said tines projecting through said recesses transversely to a longitudinal direction of said recesses, and for clamping the stack in said container while said container is being rotated and said recesses in said sidewall of said container being formed to allow said holder and said tines to move in a direction parallel to the longitudinal direction of said recesses, relative to said container, for removing the stack from said container; and a conveying support configured to support the stack in the processing orientation and to move the stack in a feed direction;

said conveying support being separate from said rotary device.

2. The device according to claim 1, further comprising a conveying tray configured for receiving the stack in the processing orientation and for moving the stack in the feed direction.

3. The device according to claim 2, wherein said conveying support is movable synchronously with said conveying tray.

4. The device according to claim 1, further comprising a tray support for supporting the stack in the processing orientation and movable in the feed direction, wherein said tray support is disposed upstream of said conveying support in the feed direction when conveying the stack.

5. The device according to claim 4, wherein said tray support is movable synchronously with said conveying tray.

6. The device according to claim 4, wherein said conveying support and said tray support are movable in the feed direction and in opposition to the feed direction independently of one another.

7. The device according to claim 1, wherein one or both of said holder and said conveying support is a fork-shaped device.

8. The device according to claim 1, wherein said recesses are formed to enable said conveying support to reach through the open top into said container.

9. The device according to claim 8, wherein said rotary device and said holder are configured to secure the stack to said container during rotation.

10. The device according to claim 1, further comprising a sensor, an evaluating device with internal logic connected to said sensor and configured to determine a stack quality, and a presenting station in which the stack quality can be improved.

11. The device according to claim 1, wherein said holder is coupled with said rotary device for enabling a movement thereof in synchronicity.

* * * * *